US008668118B2

(12) United States Patent
Tsai et al.

(10) Patent No.: US 8,668,118 B2
(45) Date of Patent: Mar. 11, 2014

(54) REPLENISHABLE LIQUID SOAP DISPENSING APPARATUS

(75) Inventors: Huang Tsai, New Taipei (TW); Kuan-Jen Chen, New Taipei (TW)

(73) Assignee: Hokwang Industries Co., Ltd., New Taipei (TW)

( * ) Notice: Subject to any disclaimer, the term of this patent is extended or adjusted under 35 U.S.C. 154(b) by 33 days.

(21) Appl. No.: 13/337,771

(22) Filed: Dec. 27, 2011

(65) Prior Publication Data

US 2013/0161358 A1 Jun. 27, 2013

(51) Int. Cl.
*B65D 88/54* (2006.01)
*B67D 7/58* (2010.01)
*B67D 7/06* (2010.01)

(52) U.S. Cl.
USPC ..... 222/325; 222/333; 222/180; 222/383.1

(58) Field of Classification Search
USPC ..... 222/183, 182, 325, 52, 63, 23, 180, 222/181.1, 181.2, 181.3, 333, 383.1
See application file for complete search history.

(56) References Cited

U.S. PATENT DOCUMENTS 5,209,377 A 5/1993 Steiner et al.
5,791,525 A 8/1998 Fan
6,607,103 B2 * 8/2003 Gerenraich et al. ..... 222/183
7,540,397 B2 * 6/2009 Muderlak et al. ..... 222/400.5
7,980,421 B2 * 7/2011 Ophardt et al. ..... 222/1
8,020,733 B2 * 9/2011 Snodgrass ..... 222/325
8,071,933 B2 * 12/2011 Ophardt et al. ..... 250/221
8,261,950 B2 * 9/2012 Cittadino et al. ..... 222/321.7
8,308,027 B2 * 11/2012 Law et al. ..... 222/52

FOREIGN PATENT DOCUMENTS

TW M374830 3/2010

* cited by examiner

*Primary Examiner* — Kevin P Shaver
*Assistant Examiner* — Stephanie E Williams
(74) *Attorney, Agent, or Firm* — Muncy, Geissler, Olds & Lowe, P.C.

(57) ABSTRACT

A replenishable liquid soap dispensing apparatus includes a liquid soap container, a soap dispensing device and a support rack. The liquid soap container includes a holding portion, a bottle opening on the holding portion and at least one lean portion on the holding portion. The soap dispensing device has a soap intake tube connecting to the liquid soap container to draw liquid soap, a soap discharge tube connecting to the soap intake tube to discharge the liquid soap and a pressurizing mechanism to increase the pressure in the soap intake tube and soap discharge tube to send the liquid soap from the soap intake tube towards the soap discharge tube. The support rack includes a first support portion to hold the soap dispensing device and a second support portion corresponding to and coupling with the lean portion to hold the liquid soap container.

9 Claims, 5 Drawing Sheets

REPLENISHABLE LIQUID SOAP DISPENSING APPARATUS

FIELD OF THE INVENTION

The present invention relates to a soap dispensing apparatus and particularly to a replenishable liquid soap dispensing apparatus that is easier to refill liquid soap.

BACKGROUND OF THE INVENTION

Conventional soap dispensing apparatus such as U.S. Pat. No. 5,791,525 includes a rear lid, a soap bottle to hold liquid soap with a lower end connecting to a soap discharge portion and a front cover to cover the rear lid and encase the soap bottle. The rear lid has a first clamp portion to clamp an opening side of the bottle and a second clamp portion to clamp the soap discharge portion. When refilling the liquid soap in the soap bottle is required, the first and second clamp portions are removed. Such a structure makes removing the soap bottle easier. However, to refill the liquid soap the front cover has to be detached to remove the soap bottle. Moreover, the structure of holding the soap bottle via the first and second clamp portions are not sturdy. Frequently loading and unloading operations easily deform the junctions of the first and second clamp portions and the rear lid, and result in damage of the structure that could make the apparatus unusable.

U.S. Pat. No. 5,209,377 also discloses a soap dispensing system which includes a soap container, a soap discharge portion connecting to the lower end of the soap container and a holder to hold the soap container. The soap container includes a latch groove for positioning. The holder has a trough corresponding to the latch groove. When refilling liquid soap is required, the soap container can be easily separated and removed from the holder via the latch groove and trough. It provides a sturdier structure and can remedy the drawback of the previous technique that easily deforms at the junctions and becomes damaged caused by frequent loading and unloading. However, its soap discharge portion and soap container are integrated. During refilling the remnant liquid soap in the tube easily spills out and smears the floor. Hence its soap discharge portion with the outlet facing down is not suitable for automatic soap dispensing apparatus installed on a countertop.

R.O.C. patent M374830 discloses an automatic soap dispensing apparatus which includes a soap container to hold liquid soap, a compression pump located at the opening of the soap container to draw the liquid soap, a driving module butting the compression pump to discharge the liquid soap, a liquid soap piping connecting to the compression pump to transport the liquid soap and a hood to encase all other elements. The automatic soap dispensing apparatus thus formed can be incorporated with a soap dispensing faucet. When users place their hands below the faucet, a sensor on the faucet transmits an activation signal to the soap dispensing apparatus, the liquid soap is dispensed from the soap container to the faucet to be used by the users for cleaning. However, when refilling the liquid soap is needed the compression pump has to be unfastened from the soap container by screwing, and this involves troublesome screw fastening structures. Moreover, the soap container is suspended. The weight of the soap container makes unscrewing from the compression pump difficult. Inadvertent operation could easily drop the soap container and mess the floor with liquid soap.

SUMMARY OF THE INVENTION

The primary object of the present invention is to solve the problems caused by inconvenient liquid soap refilling of the conventional techniques.

To achieve the foregoing object the present invention provides a replenishable liquid soap dispensing apparatus that includes a liquid soap container, a soap dispensing device and a support rack. The liquid soap container includes a holding portion, a bottle opening on the holding portion and at least one lean portion on the holding portion. The lean portion includes two protruding portions located at two sides of the holding portion and two recesses indented from the two sides of the holding portion and located below the protruding portions respectively. The soap dispensing device has a soap intake tube connecting to the liquid soap container to draw liquid soap, a soap discharge tube connecting to the soap intake tube to discharge the liquid soap and a pressurizing mechanism to increase the pressure in the soap intake tube and soap discharge tube to send the liquid soap from the soap intake tube to the soap discharge tube. The support rack includes a first support portion to hold the soap dispensing device, and a second support portion corresponding to and coupling with the lean portion to hold the liquid soap container. The second support portion includes two guiding portions to hold the protruding portions respectively, and each of the two guiding portions containing an opening at one end thereof to receive one protruding portion and a carrying portion at the bottom thereof to inserting into one recess to support the liquid soap container.

In one embodiment, the pressurizing mechanism includes a compression pump located on the bottle opening with two ends connecting to the soap intake tube and soap discharge tube, a sway portion butting the compression pump to pressurize the holding portion to send the liquid soap from the soap intake tube to the soap discharge tube, and a driving module to drive the sway portion to apply a force on the compression pump.

In another embodiment, the compression pump includes a flat deck attached to the bottle opening.

In yet another embodiment, the driving module includes a driving motor, a gear set driven by the driving motor and a housing to hold the driving motor and gear set.

In yet another embodiment, the soap dispensing device has a power switch triggered by the lean portion for activation when the protruding portion is installed in the guiding portion.

In yet another embodiment, the guiding portion includes an aperture located between the soap dispensing device and protruding portion to allow the power switch to pass through.

In yet another embodiment, the guiding portion includes a retaining member at the opening thereof to confine the protruding portion from sliding outwards.

In yet another embodiment, the guiding portion includes a directing member at the opening thereof to direct the protruding portion to enter the guiding portion.

In yet another embodiment, the liquid soap container includes a handle on the holding portion.

Compared with the conventional techniques, the invention provides the lean portion mounted onto the second support portion to support the liquid soap container so that the soap container does not have to be fastened to the apparatus by screwing. During refilling of the liquid soap the simple guiding portion design allows the liquid soap container to be unloaded and reloaded again easily. Thus the liquid soap can be refilled or replaced simply and easily.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
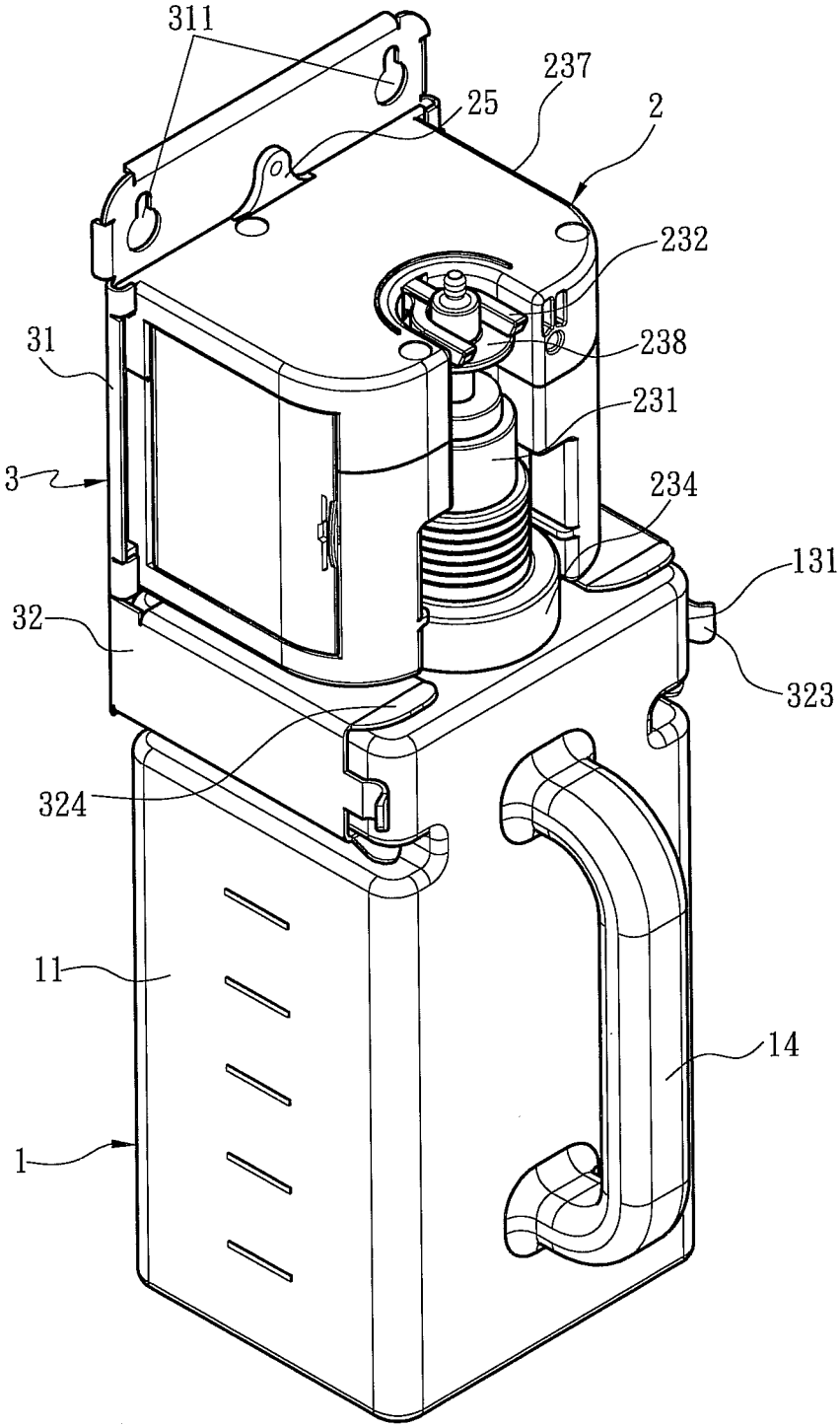
FIG. 1 shows a perspective view of the replenishable liquid soap dispensing apparatus of the invention.

Please referring to FIG. 1, the present invention aims to provide a replenishable liquid soap dispensing apparatus that includes a liquid soap container 1 to hold liquid soap, a soap dispensing device 2 located above the liquid soap container 1 to apply a pressure to the liquid soap container 1 to draw the liquid soap and a support rack 3 to hold the soap dispensing device 2. The support rack 3 provides a structure to facilitate replacement of the liquid soap container 1 by separating or coupling therewith. Thus forms the main structure of the invention.

Figure 2:
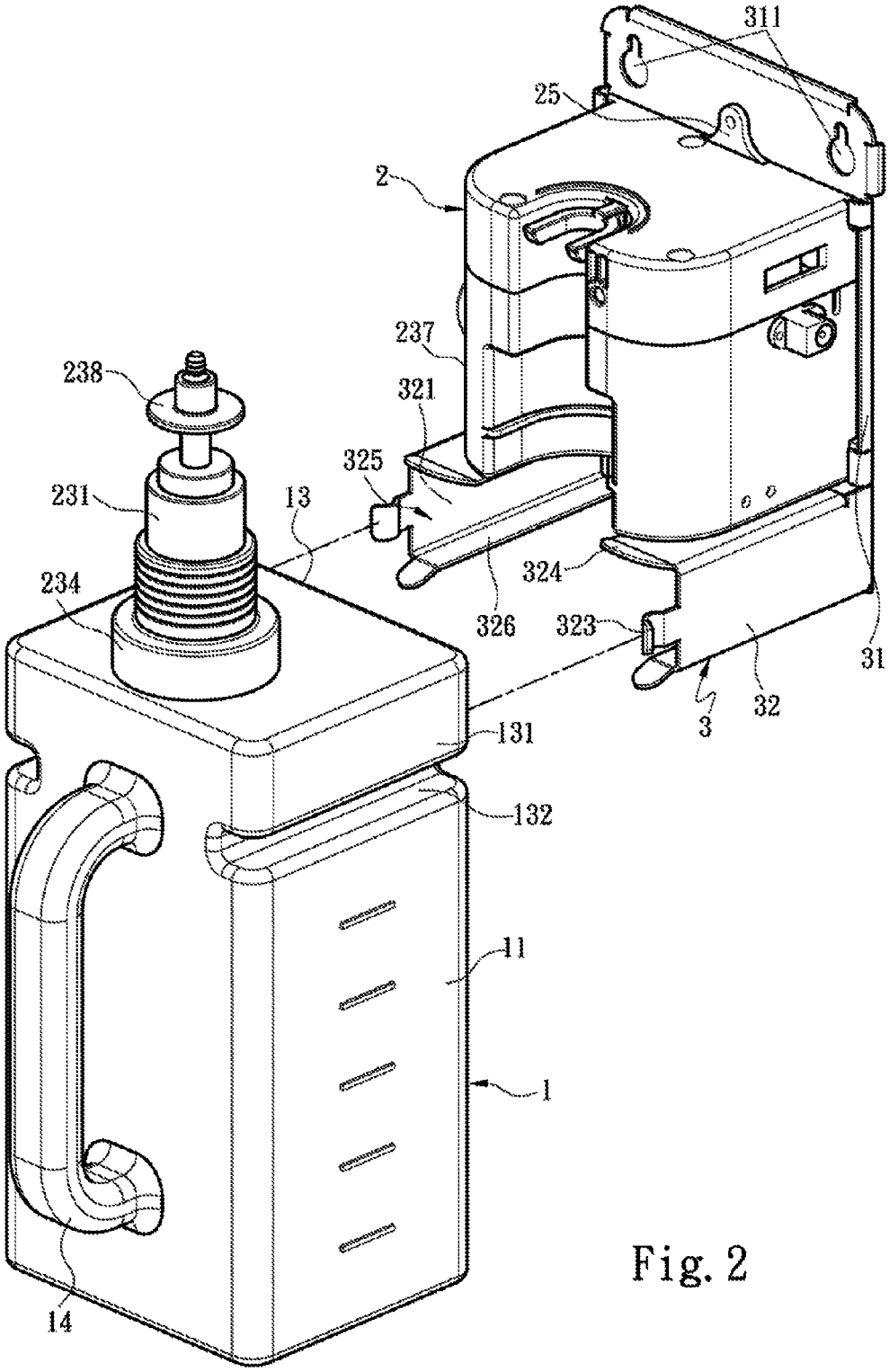
FIG. 2 shows a schematic view of the invention showing the liquid soap container and support rack in a coupling condition.
Figure 3:
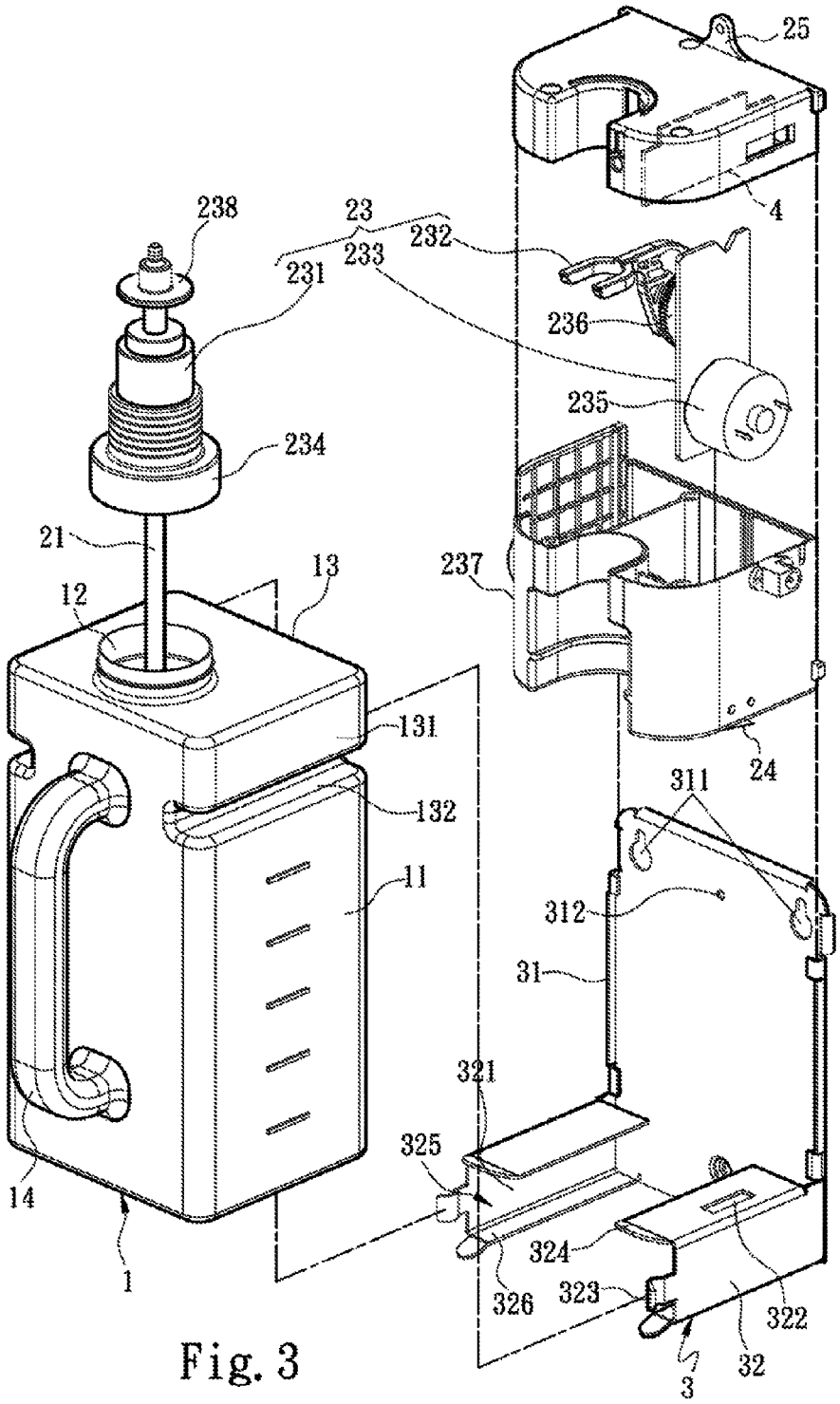
FIG. 3 shows an exploded view of the replenishable liquid soap dispensing apparatus of the invention.

Also refer to FIGS. 1, 2 and 3 for detailed structure of the support rack 3 and liquid soap container 1. The liquid soap container 1 includes a holding portion 11, a bottle opening 12 at one end of the holding portion 11 and a lean portion 13 at each of two sides of the holding portion 11. The lean portion 13 has a protruding portion 131 and a recess 132 indented from the holding portion 11 and located below the protruding portions 131. The holding portion 11 has a handle 14 at one side opposite to the support rack 3 to facilitate loading and unloading of the liquid soap container 1. The support rack 3 includes a first support portion 31 to hold the soap dispensing device 2 and a second support portion 32 connecting to the first support portion 31 to hold the liquid soap container 1. The first support portion 31 includes two positioning holes 311 for fastening to a wall and a first anchor portion 312 corresponding to a second anchor portion 25 formed on the soap dispensing device 2. The second anchor portion 25 is located on an upper end of the soap dispensing device 2 to be fastened to the first support portion 31. The second support portion 32 has two guiding portions 321 corresponding to the protruding portions 131. Each guiding portion 321 has an opening 325 at one end to receive one protruding portion 131, and a carrying portion 326 at the bottom thereof to inserting into one recess 132 to support the liquid soap container 1. The guiding portion 321 has a retaining member 323 at the opening to confine the protruding portion 131 from sliding outward and a directing member 324 to guide the protruding portion 131 to enter the guiding portion 321. For mounting of the liquid soap container 1 onto the second support portion 32, first, wedge the protruding portion 131 into the guiding portion 321 via directing of the directing member 324 through the opening 325 of the guiding portion 321; after the protruding portion 131 has fully entered the guiding portion 321, the carrying portions 326 are inserted into the recesses 132 respectively to support the liquid soap container 1, and the retaining member 323 at two sides of the opening 325 butts one side of the protruding portion 131 close to the opening 325 to form retaining. When removing the liquid soap container 1 from the second support portion 32 is desired, grip the handle 14 and draw outwards, the protruding portion 131 pushes the retaining member 323 sideward and can be removed from the guiding portion 321.

Figure 4:
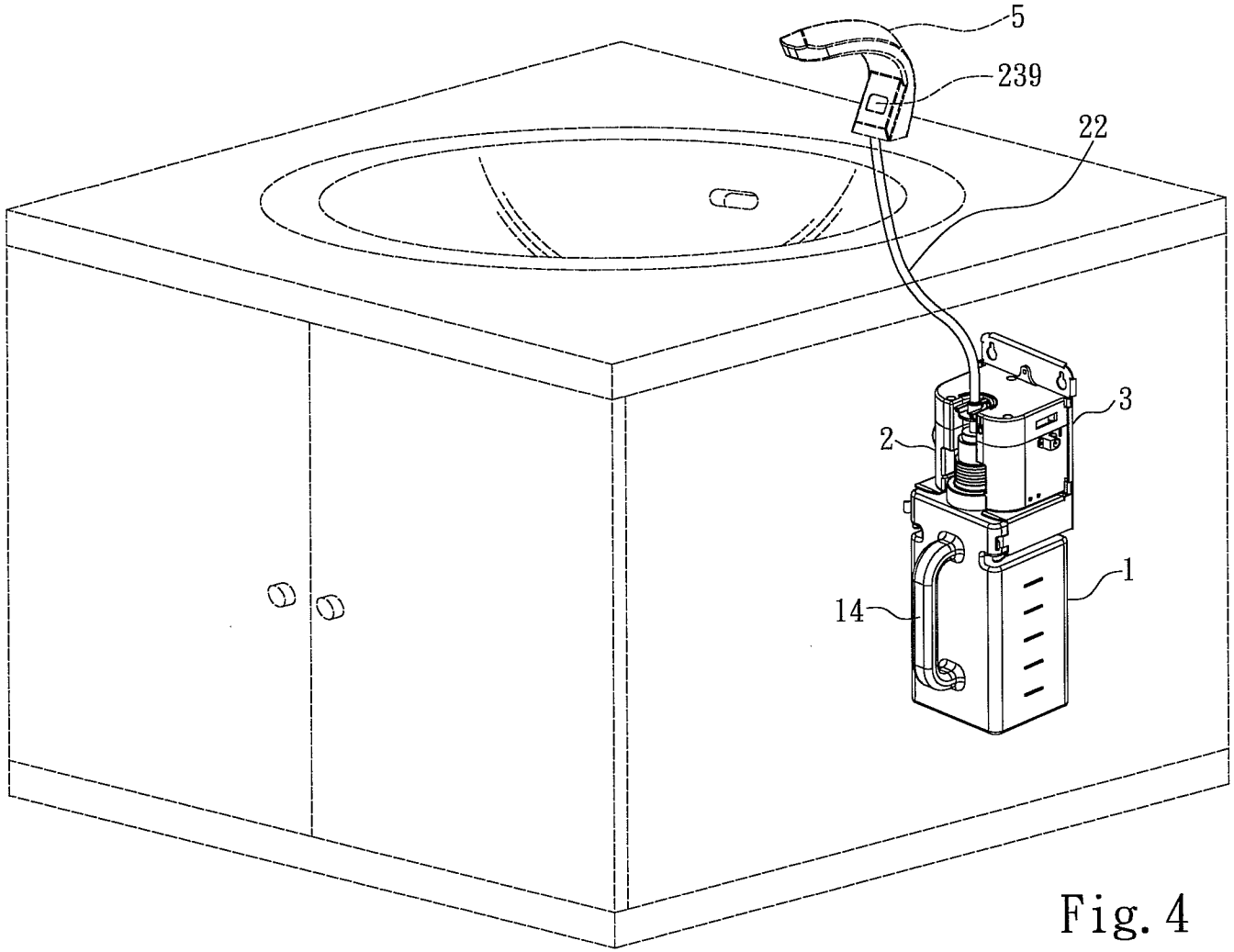
FIG. 4 shows a schematic view of an embodiment of the invention installed on a countertop.

Please refer to FIGS. 3 and 4 for the soap dispensing principle of the invention. The soap dispensing device 2 has a soap intake tube 21 with one end located in the holding portion 11 to draw the liquid soap and another end connecting to a soap discharge tube 22. The soap intake tube 21 and soap discharge tube 22 are bridged by a pressurizing mechanism 23 which increases the pressure in the soap intake tube 21 and soap discharge tube 22 to send the liquid soap from the holding portion 11 to the soap discharge tube 22.

The pressurizing mechanism 23 includes a compression pump 231 with a flat deck 234 fastened to the bottle opening 12, and has two ends connecting to the soap intake tube 21 and soap discharge tube 22. The compression pump 231 has a press portion 238 butted by a sway portion 232 which is driven by a driving module 233. The driving module 233 includes a driving motor 235 and a control circuit board 4 electrically connected to the driving motor 235 and a sensor 239, a gear set 236 driven by the driving motor 235 and a housing 237 to house all the aforesaid elements. When the sensor 239 detects approaching of user's hands, it transmits a trigger signal to the control circuit board 4 to activate the driving motor 235. The driving motor 235 drives the gear set 236 which is coupled with the sway portion 232 at an elevation difference so that the sway portion 232 sways up and down to press the press portion 238 of the compression pump 231 to increase the pressure in the liquid soap container 11, thereby the liquid soap is sent from the soap intake tube 21 to the soap discharge tube 22.

To prevent inadvertent triggering of the sensor 239 during replacement of the liquid soap container 11, the soap dispensing device 2 further includes a power switch 24 at the bottom of the housing 237. The guiding portion 321 has an aperture 322 run through by the power switch 24. When to remove the liquid soap container 1 from the support rack 3 is wanted, separate the power switch 24 from the protruding portion 131 previously butted thereon, the power source of the soap dispensing device 2 is cut off. When the liquid soap container 1 is reloaded into the guiding portion 321 the protruding portion 131 presses the power switch 24 to reactivate the soap dispensing device 2.

Please refer to FIG. 4 for an embodiment of the invention installed on a countertop. The apparatus of the invention can be installed beneath the countertop of a washing sink. The soap discharge tube 22 is connected to a soap discharge faucet 5 which has the sensor 239 installed thereon. When the sensor 239 detects approaching of an external object the soap dispensing device 2 delivers the liquid soap towards the soap discharge faucet 5. To refill the liquid soap in the liquid soap container 1, open the washing sink below the countertop, grip the handle 14 to remove the liquid soap container 1 outward, then the liquid soap can be refilled without other cumbersome actions.

Figure 5:
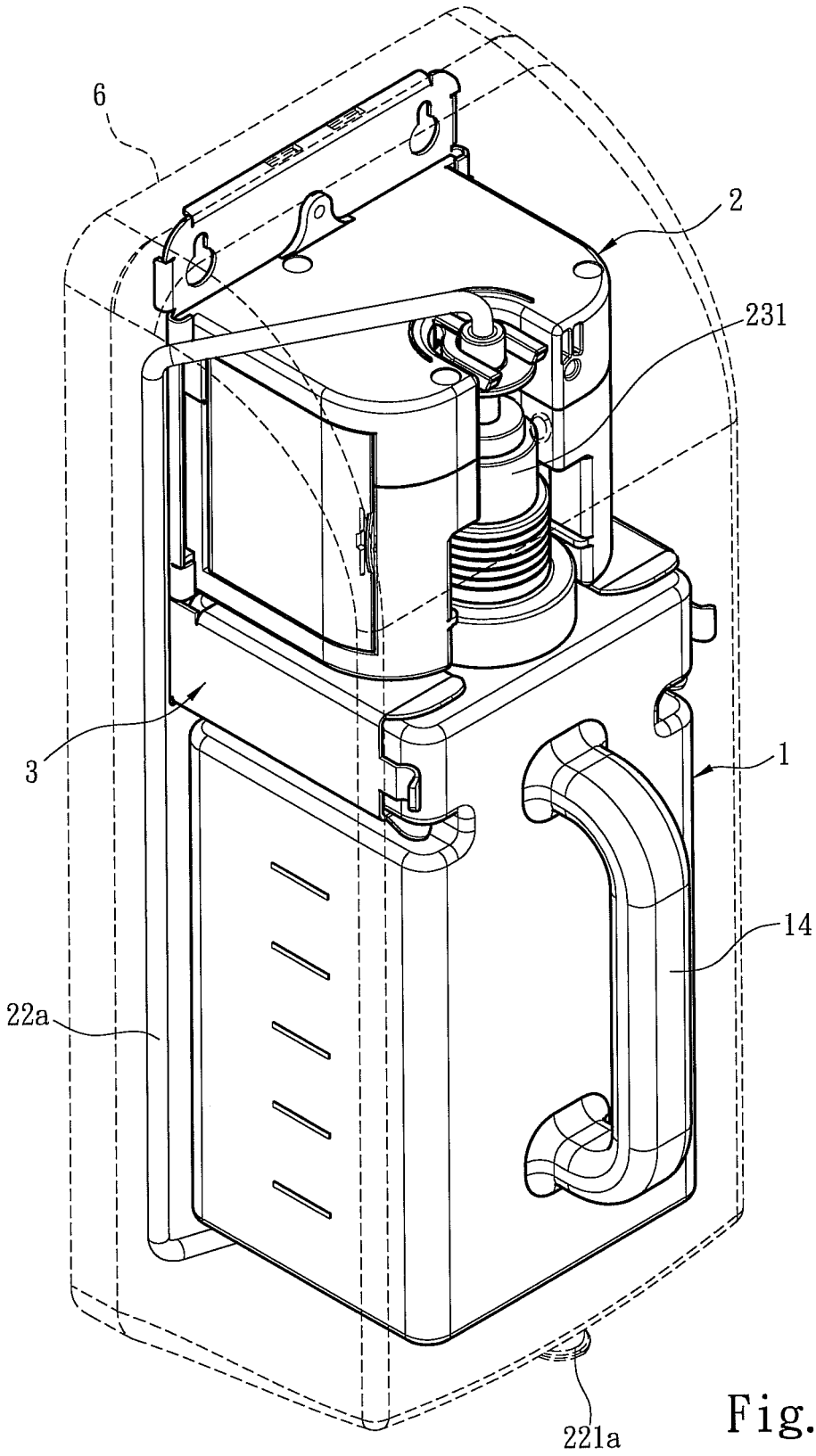
FIG. 5 shows a schematic view of another embodiment of the invention installed on a wall by hanging.

Please refer to FIG. 5 for another embodiment with the apparatus of the invention mounted onto a wall by hanging. It can be hung on the wall of a bathroom or lavatory, and includes a soap discharge tube 22*a* connected to the compression pump 231 and extended downward therefrom, a sensor (not shown in the drawing) near the outlet of the soap discharge tube 22*a* and a hood 6 encased the apparatus with an opening at a lower end. The soap discharge tube 22*a* has one end formed a soap outlet 221*a*. When the sensor detects user's hands approaching the soap outlet 221*a*, the soap dispensing device 2 immediately dispenses the liquid soap via the soap discharge tube 22*a* to the user's hands. When replenishing the liquid soap in the liquid soap container 1, user can only open the hood 6 to remove the empty liquid soap container 1 and reload another liquid soap container 1 simply and quickly.

As a conclusion, through the support rack provided by the invention, the soap dispensing device and liquid soap container can be coupled together securely. Through the guiding portion on the second support portion and the protruding portion on the liquid soap container the liquid soap container can be loaded and unloaded easily on and from the support rack, and the liquid soap in the liquid soap container can be replenished easily. It provides significant improvements over the conventional techniques.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A replenishable liquid soap dispensing apparatus, comprising:

a liquid soap container including a holding portion, a bottle opening formed on the holding portion and at least one lean portion located on the holding portion, wherein the lean portion includes two protruding portions located at two sides of the holding portion and two recesses indented from the two sides of the holding portion and located below the protruding portions respectively;

a soap dispensing device including a soap intake tube connected to the liquid soap container, a soap discharge tube connected to the soap intake tube to discharge liquid soap and a pressurizing mechanism to increase pressure in the soap intake tube and the soap discharge tube to send the liquid soap from the soap intake tube towards the soap discharge tube; and a support rack including a first support portion to hold the soap dispensing device and a second support portion coupled with the lean portion to hold the liquid soap container, wherein the second support portion includes two guiding portions to hold the protruding portions respectively, and each of the two guiding portions contain an opening at one end thereof to receive one protruding portion and a carrying portion at the bottom thereof to insert into one recess to support the liquid soap container.

2. The replenishable liquid soap dispensing apparatus of claim 1, wherein the pressurizing mechanism includes a compression pump located at the bottle opening and including two ends connecting respectively to the soap intake tube and the soap discharge tube, a sway portion butting the compression pump to give pressure in the holding portion to move the liquid soap from the soap intake tube to the soap discharge tube and a driving module to drive the sway portion to apply a force on the compression pump.

3. The replenishable liquid soap dispensing apparatus of claim 2, wherein the compression pump includes a flat deck fastened to the bottle opening.

4. The replenishable liquid soap dispensing apparatus of claim 2, wherein the driving module includes a driving motor, a gear set driven by the driving motor and a housing to house the driving motor and the gear set.

5. The replenishable liquid soap dispensing apparatus of claim 1, wherein the soap dispensing device includes a power switch triggered by the lean portion during loading of the protruding portion into the guiding portion.

6. The replenishable liquid soap dispensing apparatus of claim 5, wherein the guiding portion includes an aperture located between the soap dispensing device and the protruding portion and run through by the power switch.

7. The replenishable liquid soap dispensing apparatus of claim 1, wherein the guiding portion includes a retaining member at the opening thereof to confine the protruding portion from sliding outwards.

8. The replenishable liquid soap dispensing apparatus of claim 1, wherein the guiding portion includes a directing member at the opening thereof to guide the protruding portion to enter the guiding portion.

9. The replenishable liquid soap dispensing apparatus of claim 1, wherein the liquid soap container includes a handle located on the holding portion.

* * * * *